United States Patent [19]

Noisier

[11] Patent Number: 4,941,999

[45] Date of Patent: Jul. 17, 1990

[54] FUEL SUPPLY DEVICE WITH COOLED FLOW CHAMBER

[75] Inventor: Guy Noisier, Brunoy, France

[73] Assignee: Solex, France

[21] Appl. No.: 322,290

[22] Filed: Mar. 13, 1989

[30] Foreign Application Priority Data

Mar. 23, 1988 [FR] France ..... 88 03807

[51] Int. Cl.[5] ..... F02M 5/10

[52] U.S. Cl. ..... 261/130; 261/36.2; 261/72.1; 261/DIG. 81; 123/541

[58] Field of Search ..... 261/36.2, 130, 131, 261/151, 72.1, DIG. 81; 123/541, 540

[56] References Cited

U.S. PATENT DOCUMENTS

| | | | |
|---|---|---|---|
| 1,974,586 | 9/1934 | Prentiss | 123/540 |
| 3,196,926 | 5/1962 | Gartland | 158/36.3 |
| 3,628,516 | 12/1971 | Perrin | 261/DIG. 81 |
| 3,882,692 | 5/1975 | Watanabe et al. | 123/540 |
| 4,036,188 | 7/1977 | Sami et al. | 123/540 |
| 4,084,564 | 4/1978 | Rickert | 123/541 |
| 4,098,236 | 7/1978 | Okawa | 261/DIG. 81 |
| 4,364,355 | 12/1982 | Karino | 123/541 |
| 4,715,327 | 12/1987 | Eberhardt | 261/DIG. 20 |

FOREIGN PATENT DOCUMENTS

| | | | |
|---|---|---|---|
| 8406706 | 3/1984 | Fed. Rep. of Germany . | |
| 2036327 | 3/1969 | France . | |
| 53-146037 | 12/1978 | Japan | 261/DIG. 81 |
| 843582 | 8/1960 | United Kingdom | 261/DIG. 20 |

*Primary Examiner*—Tim Miles

*Attorney, Agent, or Firm*—Larson and Taylor

[57] ABSTRACT

A fuel supply device for an internal combustion engine comprises a constant level chamber (typically a float chamber) formed in a casing which may be the body of the carburetor of the device. A heat exchanger is formed in the casing or in contact with the casing. A cooling liquid is circulated in a closed-loop circuit including the heat exchanger and a liquid reservoir having a large volume as compared with that of the balance of the circuit.

8 Claims, 2 Drawing Sheets

FIG.1.
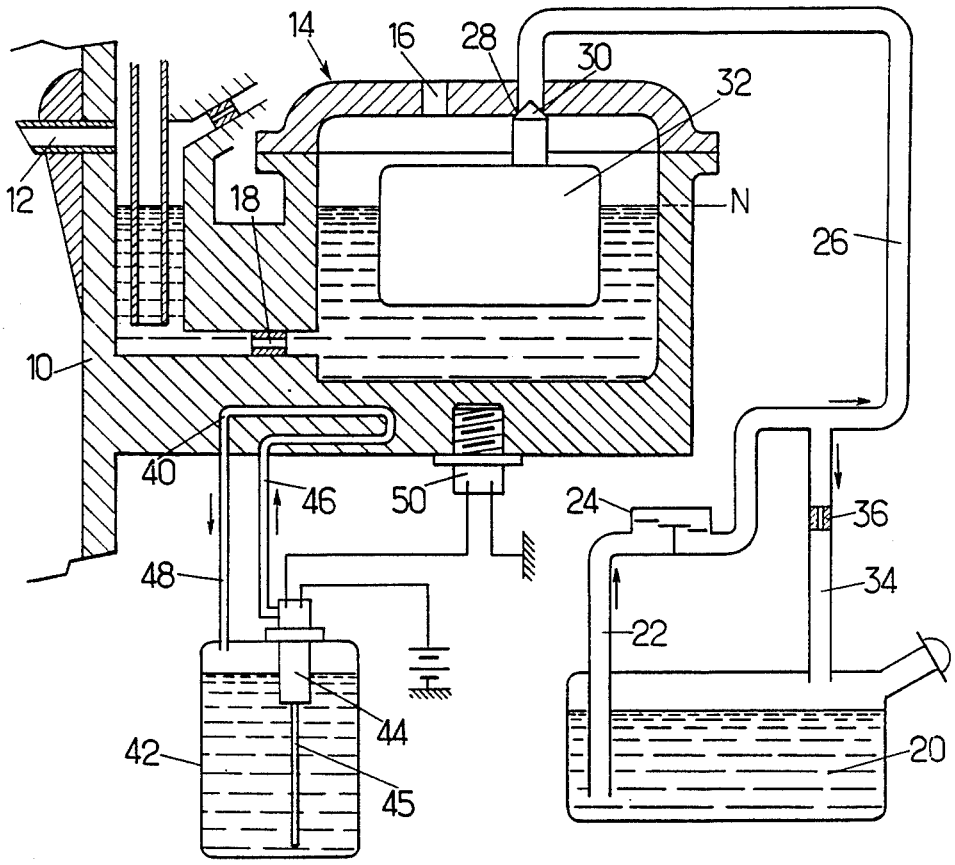
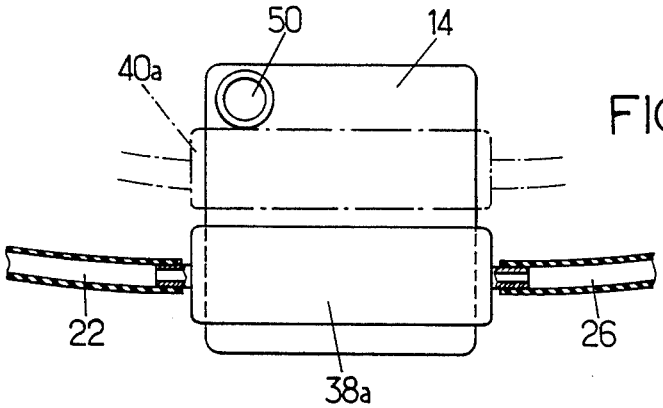
FIG.2.

FUEL SUPPLY DEVICE WITH COOLED FLOW CHAMBER

BACKGROUND OF THE INVENTION

1. Technical Field

The invention relates to a fuel supply device for an internal combustion engine, comprising a constant level chamber formed in a casing placed in the vicinity of the engine.

The invention is particularly suitable for use in carburetors whose constant level chamber is generally formed in the body of the carburetor itself, consisting of a casting. The constant level chamber of such a carburetor receives heat from the engine when the latter is hot. When the engine is stopped, the carburetor is not cooled any more by air expansion and fuel evaporation within it through the carburetor. The fuel contained in the chamber can be heated to boiling point and overflow, at least partially, into the induction passage. An attempt to restart the engine may fail due to an excessive fuel/air ratio of the mixture delivered to the engine.

2. Prior Art

This problem has been known for long. Attempts have been made to solve it in different ways, particularly by placing an insulating plate between the intake pipe of the engine and the carburetor. But such insulation is often insufficient, for the metal bolts fixing the body of the carburetor to the duct form a heat leak path. Attempts have also been made to cool the carburetor body by a flow of fuel from the tank (German No. 84 06706, French No. 2,036,327, U.S. Pat. No. 3,196,926 to Gartland). This solution complicates a circuit transporting very inflammable liquid.

SUMMARY OF THE INVENTION

It is an object of the invention to provide a supply device having a constant level chamber less subject to the problem of percolation without the hazards associated with the use of fuel as cooling fluid.

To this end, there is provided a device in which the means for cooling the chamber comprises a heat exchanger in thermal contact with the chamber and means for circulating a cooling liquid through a closed circuit comprising the exchanger and a reservoir of liquid of large volume as compared with the balance of the closed circuit.

The flow means may be devoid of active flow member and operate for example by thermo-siphon effect. Such flow means may for example be formed by ducts connecting the heat exchanger to the reservoir of a windscreen washer placed at a level higher than that of the exchanger. The cooling liquid is then the water of the windscreen washer. The flow means may also comprise an active member such as a pump. The pump may be a very simple electric pump when use is made of the water of the windscreen washer whose capacity will be increased with respect to the values usual at the present time. The electric motor is then energized when the temperature of the chamber exceeds a given volume and/or for a given time after the engine has come to rest.

The invention will be better understood from the following description of particular embodiments given by way of examples only. The description refers to the accompanying drawings.

BRIEF DESCRIPTION OF THE DRAWINGS

FIG. 1 is a general diagram showing an embodiment of the invention;

FIG. 2 shows a method of mounting the heat exchanger on the chamber of a carburetor, in a modified embodiment of the invention;

DETAILED DESCRIPTION OF PREFERRED EMBODIMENTS

Figure 3:
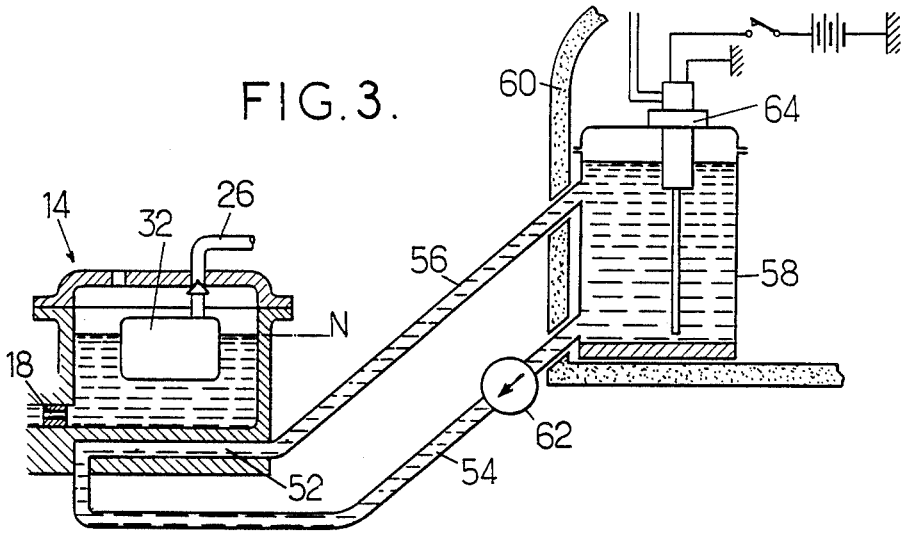
FIG. 3 shows another embodiment.

The fuel supply device partly shown in FIG. 1 comprises a carburetor, of which only the components concerned by the invention have been illustrated. The carburetor has a body in which is formed an induction passage 10 into which a main fuel jetting circuit opens through a passage 12. The main jetting circuit is fed with fuel from a constant level chamber 14 provided with a vent orifice 16. The chamber is connected to the main jetting circuit by a jet 18. It receives fuel from a tank 20 through a fuel pipe 22, a pump 24 and a duct 26. Duct 26 opens into chamber 14 through a seat 28 which can be closed by the needle 13 of a float 32. This arrangement makes it possible to maintain the free surface of the fuel in the chamber at a constant level N. The invention is also applicable to overflow constant level chambers.

Part of the fuel delivered by pump 24 returns to tank 20 through a return duct 34 having a calibrated restriction 36.

A heat exchanger through which a liquid flows is placed in thermal contact with the chamber. In the embodiment shown in FIG. 1, the heat exchanger is formed by a passage 40 formed in the wall of the casing defining the chamber. The passage may be formed during manufacture of the body of the carburetor, by casting.

A liquid is circulated in closed circuit through the heat exchanger 40 when the temperature of the chamber exceeds a given value. The cooling liquid in the closed loop circuit is, for example, water contained in the windscreen washer reservoir 42 which is then given a volume greater than that which is usual (5 liters instead of 2 liters for example). The closed circuit comprises a circulating pump 44 whose inlet pipe 45 is immersed in the liquid, a delivery conduit from the pump to the exchanger 40 and a return duct 48 to the reservoir. It is preferable to provide the reservoir 42 with a sensor which lights a warning light on the dashboard of the vehicle when the level of water drops too much.

Pump 44 is provided with a control circuit whose detector is a temperature sensor 50 in contact with the wall of the chamber and which may for example be a thermal switch which closes as soon as the temperature of the bottom wall of chamber 14 exceeds a predetermined limit value, for example between 40° C. and 60° C. A timer may also be provided for limiting the duration of operation of pump 44 from the instant the ignition switch is cut off.

Operation is then as follows: if the temperature of the chamber of the carburetor becomes higher than a predetermined temperature, the thermal switch 50 closes. Pump 34 circulates water in the vicinity of the fuel contained in the chamber and thus avoids fuel evaporation and discharge into the intake pipe of the engine by percolation due to heat migrating from the hot engine.

The system shown in FIG. 1 may be of very low cost if elements are used already existing in the vehicle, as for example those of a windscreen washer: the pump of the windscreen washer may even be used which should be completed by a valve normally closing the passage towards the windscreen and opening as soon as the windscreen washer is caused to operate. It is however more advantageous to provide a low cost additional pump.

The temperature rise of the water of the windscreen washer caused by implementing the invention is of advantage since it will render cleaning of the windscreen of the vehicle more efficient.

Instead of using the water reservoir of the windscreen washer, a special reservoir containing an antifreeze liquid may be provided and sealed so as to avoid having to fill it periodically.

In some cases, for example when it is desired to retrofit existing carburetors or to avoid modifying a casting mould for applying the invention to carburetors already in manufacture, the heat exchanger may be placed against the chamber instead of being integrated in the wall thereof. In the embodiment shown in FIG. 2, the heat exchanger is formed as a liquid circulation box 38*a*, advantageously of heat conducting material (copper or brass, for example) welded to the bottom of the chamber so as to reduce the thermal impedance at the interface. It is even possible to provide two exchangers 38*a* and 40*a* side by side, one of which being swept by fuel fed to the float chamber, the other having liquid flowing therethrough in closed circuit.

It is then of advantage to locate the boxes 38*a* and 40*a* against the bottom wall of the chamber, so as to have a flat bearing.

In the modification shown in FIG. 3, in which the elements already described again bear the same reference number, the cooling liquid flows through exchanger 52 by thermo-siphon effect. Exchanger 52 is connected by inlet and outlet lines 54, 56 to a reservoir of liquid 58 placed at a higher level, which may once again be the reservoir of the windscreen washer further having its usual pump 54. Circulation then takes place from the lower point of reservoir 58 to the exchanger 52 and from exchanger 52 to the higher point of the reservoir. An insulating wall 60 may provided between the windscreen washer and the engine to avoid heating of the liquid in the reservoir. An electric pump 62 may be provided for enhancing the flow when the temperature of the chamber, detected by a sensor (not shown), exceeds a predetermined value.

I claim:

1. Fuel supply device for internal combustion engine, comprising a constant level chamber defined by a casing for location in close proximity to the engine, a heat exchanger in thermal contact with said casing, and means for circulating a cooling liquid in a closed-loop circuit including said heat exchanger and a windshield cleaner reservoir having a size sufficient for containing a volume of said cooling liquid which is large as compared with the volume of the balance of the closed-loop circuit.

2. Device according to claim 1, wherein said circulation means further comprise an electric pump for enhancing thermosiphon circulation and means, including a temperature sensor in contact with said casing, for energizing said pump responsive to the temperature of the casing exceeding a predetermined value.

3. Device according to claim 1, wherein said windshield cleaner reservoir has a volume greater than that of conventional windshield cleaner reservoirs.

4. Device according to claim 1, wherein said heat exchanger is formed within a wall of a casting constituting said casing.

5. Device according to claim 1, wherein said heat exchanger is box-shaped and secured to said casing.

6. Device according to claim 1, wherein said circulation means comprise an electric pump and means for energizing said pump responsive to the temperature of the casing exceeding a predetermined value.

7. Device according to claim 6, wherein said means for energizing the pump include means for cutting-off said energization at the end of the predetermined time period after the engine is stopped.

8. Device according to claim 6, wherein said means for energizing said jump includes a temperature sensor carried by a bottom wall of said chamber.

* * * * *